United States Patent [19]

Burd et al.

[11] Patent Number: 4,612,969

[45] Date of Patent: Sep. 23, 1986

[54] METHOD OF AND APPARATUS FOR CASTING ARTICLES WITH PREDETERMINED CRYSTALLINE ORIENTATION

[75] Inventors: Lamar Burd, Andover; Evan R. Miller, Flanders; Eugene J. Carozza, Succasunna, all of N.J.; Robert E. Grunstra, North Muskegon, Mich.

[73] Assignee: Howmet Turbine Components Corporation, Greenwich, Conn.

[21] Appl. No.: 489,065

[22] Filed: Apr. 27, 1983

[51] Int. Cl.[4] ..... B22D 25/06; B22D 27/04

[52] U.S. Cl. ..... 164/122.2; 164/125; 164/127; 164/353; 164/361

[58] Field of Search ..... 164/122.1, 122.2, 125, 164/127, 361, 353

[56] References Cited

U.S. PATENT DOCUMENTS

| | | | |
|---|---|---|---|
| 2,970,075 | 1/1961 | Grenoble | 164/122.1 X |
| 3,568,757 | 3/1971 | Piearcey | 164/122.2 X |
| 3,580,324 | 5/1971 | Copley et al. | 164/122.2 |
| 3,915,761 | 10/1975 | Tschinkel et al. | 164/127 X |

FOREIGN PATENT DOCUMENTS

| | | | |
|---|---|---|---|
| 59549 | 9/1982 | European Pat. Off. | 164/122.1 |
| 20302334 | 4/1980 | United Kingdom | 164/122.2 |
| 2037200A | 7/1980 | United Kingdom | 164/122.2 |

*Primary Examiner*—Nicholas P. Godici
*Assistant Examiner*—J. Reed Batten, Jr.
*Attorney, Agent, or Firm*—McDougall, Hersh & Scott

[57] ABSTRACT

A method and ceramic mold structure for use in producing articles having a predetermined crystalline orientation such as single crystals. The technique involves the use of a ceramic mold mounted on a chill plate with the mold defining a cavity tilted at an angle between about 5° and 75° relative to the vertical. One or more seed crystals are supported adjacent the chill plate and the orientation of the crystal is selected to provide a desired orientation in the resulting casting. The method results in improved solidification control, particularly with reference to avoiding defects caused by shrinkage.

2 Claims, 4 Drawing Figures

METHOD OF AND APPARATUS FOR CASTING ARTICLES WITH PREDETERMINED CRYSTALLINE ORIENTATION

BACKGROUND OF THE INVENTION

Various techniques are known for casting directionally solidified articles such as turbine blades and vanes. In the case of single crystals, a common method involves the use of a starter zone at the bottom of a mold wherein a plurality of columnar grains are formed A "non-linear" or transversely displaced crystal selector (e.g., a helix-shaped passage) connects the starter zone to the article cavity, and this selector insures that only one columnar grain grows into the article cavity. Single crystal castings also can be produced using molds which have a vertical "slender projection" at the bottom of the article cavity (i.e., a linear or non-transversely displaced "neck"), or using seed crystals, as described in Bridgman U.S. Pat. No. 1,793,672.

When traditional directionally solidified (columnar-grained polycrystalline) articles are desired, the starter zone communicates directly with the article cavity (no crystal selector or seed crystal is present) as described in Chandley U.S. Pat. No. 3,248,764, VerSnyder U.S. Pat. No. 3,260,505, and Piearcey U.S. Pat. No. 3,494,709.

Directionally solidified articles of either the polycrystalline or single crystal type may be cast in molds which are supported on a chill plate. The temperature gradient during solidification is established in part by selectively controlling the power input to one or more heating coils surrounding the mold. The coils are axially spaced along the vertical axis of the mold, and the mold is heated to a temperature above the pouring temperature of the alloy in order that there will be no nucleation in the mold other than at the bottom of the mold in the location of the chill plate. By control of the heat input and other parameters during the casting operation, a substantially unidirectional thermal gradient can be maintained and the solidification will occur gradually with the single or multiple columnar crystals growing axially within the mold. A general discussion of procedures of this type may be found in Phipps, et al. Pat. No. 3,712,368 and in Tingquist, et al. Pat. No. 3,841,384.

When casting articles which are of irregular design, problems can arise when apertures, small cavities, or the like are insufficiently filled with molten metal as solidification occurs. Upon cooling, shrinkage voids will occur which can result in weakened areas, and rejection of castings. In the case of turbine blades, vanes, and the like, airfoil sections are bounded by roots, shrouds, and "angel wing" portions, and these are casting areas characteristic of regions where shrinkage voids can be found.

It has been particularly found that the production of components such as turbine blades which have a relatively complex configuration can result in shrinkage voids when an attempt is made to produce unidirectionally solidified columnar grained or single crystal castings. More particularly, the extremities of the root and shroud portions of such castings have been characterized by unduly frequent shrinkage defects. These defects are not acceptable for parts which are designed for high performance applications and rejection of such castings result.

SUMMARY OF THE INVENTION

The system of this invention comprises a method and means for avoiding the occurrence of shrinkage defects in unidirectionally solidified castings. The invention particularly involves the provision of molds which contain one or more mold cavities, the mold cavities having a central axis tilted from between 5° and 75° relative to the vertical.

The mold is located in the described position on a chill plate or in association with any other means of heat extraction suitable for maintaining a desired temperature gradient throughout the interior of the mold. Upon the introduction of a molten charge, solidification will initiate at the chill plate in the starter zone, or epitaxially from a seed of the base of the mold, and the solidification front will proceed in a "vertical" direction substantially normal to the chill plate (parallel to the direction of heat withdrawal), and be characterized by liquidus and solidus isotherms that are substantially "horizontal" or parallel to the chill plate (normal to the direction of heat withdrawal). The combination of the tilted mold cavity and the horizontal solidification front result in a controlled sequential solidification of metal in complex areas of a casting such as in the shroud area of a turbine blade, whereby liquid metal is substantially always available to compensate for the volume change on solidification, and the resulting tendency toward formation of voids. Thus, the head of molten metal which is present above the solidification front of the casting will result in the feeding of molten charge into adjacent areas which would otherwise develop voids.

The invention also contemplates the optional provision of extensions on the outer extremities of complex areas of a casting, these outer extremities comprising the last areas to be solidified when a mold is tilted as above described. These extensions are provided for purposes of insuring that adequate molten charge is available to fill areas of potential voids during the solidification process. To the extent that any voids tend to be formed, these voids will be formed preferably in the extensions of the more complex casting areas, and said extensions then can be removed without detracting from the integrity of the cast article.

DETAILED DESCRIPTION OF THE INVENTION

Figure 1:
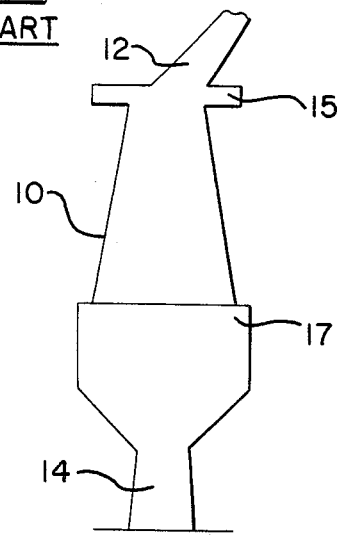
FIG. 1 PRIOR ART
FIG. 1 is an elevational view of a pattern of the type typically used for the preparation of molds to be used for the casting of a turbine blade.
Figure 2:
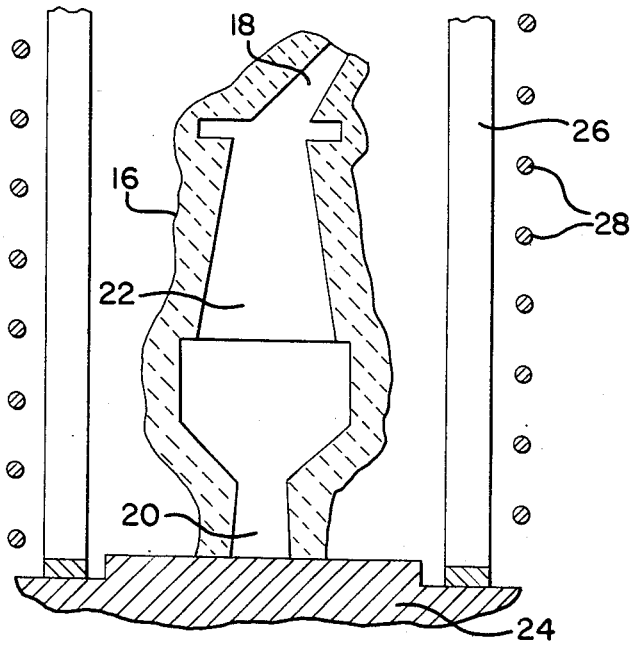
FIG. 2 PRIOR ART
FIG. 2 is a vertical, cross-sectional view of a ceramic mold produced utilizing a pattern of the type shown in FIG. 1, and also illustrating a susceptor and induction coil for controlling solidification in the mold.

FIGS. 1 and 2 illustrate typical prior art pattern and mold structures. The pattern 10 shown in FIG. 1 may be formed of wax, plastic, or other appropriate material and utilized in the production of a turbine blade. This pattern includes an extension 12 at the top which is typically provided for forming a metal feed passage in a mold. Another extension 14 at the bottom of the pattern is provided to form a passage in the mold which will ultimately be employed for removal of the pattern material after the mold has been formed. A root portion 15 is formed at one end of the pattern and a shroud portion 17 at the other end.

FIG. 2 illustrates a mold 16 which may be formed by any conventional means. For example, the mold 16 can be produced by repeatedly dipping a pattern 10 into a ceramic slurry to build up layers of ceramic around the pattern. After firing, a mold having a metal feed passage 18, a lower passage 20, and an intermediate article forming cavity 22 will result. The passage 20 is particularly useful as means for permitting removal of the pattern material, for example, where the material comprises wax or some other substance which can be brought to a fluid state and allowed to flow out of the mold.

Where a mold of the type shown is used in the formation of a single crystal or other directionally oriented castings, the mold may be mounted on a chill plate 24. The assembly may be surrounded by a susceptor 26, and induction heating coils 28 are also provided. In conventional fashion, the solidification within the mold may then be controlled by withdrawing heat through the chill plate or through other means such as convection or radiation, and controlling heat input by the coils. The casting is then directionally solidified from bottom to top, preferably by withdrawal, or using the well-known "power down" technique.

Figure 3:
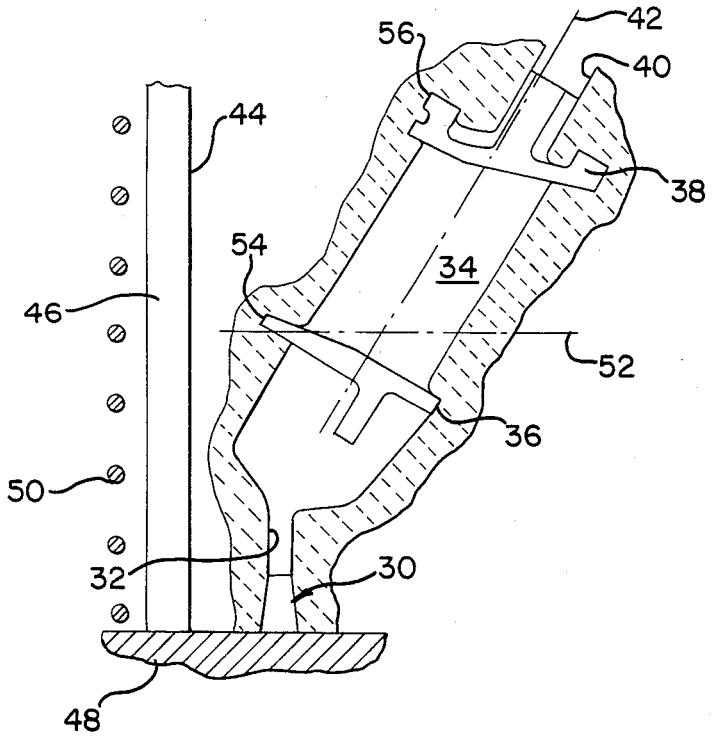
FIG. 3 is a vertical, cross-sectional view of a ceramic mold with a fragmentary showing of a chill plate and susceptor, all modified in accordance with this invention; and, FIG. 4 is a vertical, cross-sectional view of a modified form of ceramic mold of this invention.

FIG. 3 illustrates one embodiment of this invention wherein a single crystal 30 is located in a mold passage 32 which communicates with the mold cavity 34. The mold cavity includes shroud portion 38, root portion 36, and metal feed passage 40.

As shown, the axis 42 of the mold cavity is tilted at an angle relative to the vertically disposed surface 44 of the susceptor 46. In the practice of this invention, this angle may vary between about 5° and about 75° relative to the vertical, and is preferably about 30°.

In the operation of a system of the type described, solidification will commence in the usual fashion at the bottom of the mold. Furthermore, the gradient provided by the chill plate 48 and surrounding coils 50 will maintain a substantially horizontal solidification front (liquidus and solidus isotherms) which gradually moves upwardly relative to the mold cavity.

Referring to the line 52 appearing in FIG. 3, it will be appreciated that with this arrangement, molten metal is available for feeding areas of the root portion 36 with the exception of a small portion 54. Only upon movement of the solidification front above the line 52 will there be any blocking of this area 54 which would prevent the feeding of molten metal to fill a shrinkage void.

As indicated, the portion 54 of the root constitutes only a very small part of the over-all root area. Moreover, this portion can be designed with an extension so that shrinkage voids preferentially will occur within this extension. After removal of the mold, the extension can be cut away leaving cast material of a high integrity throughout the entire shroud area.

In similar fashion, virtually all portions of the shroud areas 38 will have adequate feeding of molten metal as the solidification front moves upwardly. To the extent that a portion of the shroud, such as shown at 56 may comprise a "hard-to-feed" portion, the outer envelope of the casting can be extended beyond the dimensions required for the final shroud. Shrinkage voids can then be confined to this portion of the casting with these additional stock portions being machined away as part of a finishing operation.

It will be appreciated that the turbine blade configurations shown herein are intended to be illustrative of, but not limiting upon, parts which can be cast in accordance with the concepts of this invention. These include other gas turbine engine components such as vanes, vane segments, integral components, seals and structural parts, and also fabricated assemblies wherein at least some portion thereof is a single crystal casting. Furthermore, the configurations may be varied, e.g., the root could be located in an upper position rather than in the lower position shown, or a shroud portion may be formed at both ends. In addition, many other configurations which are suitable for directional solidification, and which contain portions susceptible to the formation of shrinkage voids, can be cast in accordance with the concepts of this invention, including other heat engine components, nuclear parts, medical prosthetic devices, and space and missile articles.

Figure 4:
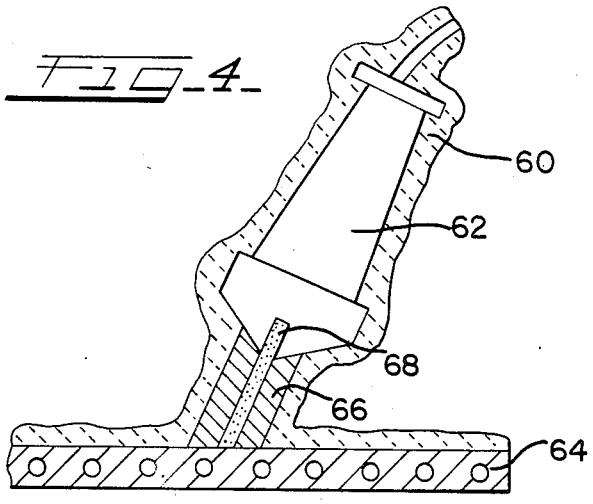

The alternate form of the invention shown in FIG. 4 includes a mold 60 with the longitudinal axis of the mold cavity 62 positioned at an angle to the vertical and tilted relative to chill plate 64. A seed cradle 66 and seed 68 are oriented with their longitudinal axes parallel to the longitudinal axis of the mold cavity 62 in the fashion described in Miller, et al. application Ser. No. 405,588, filed on Aug. 5, 1982.

As set forth in that application, the arrangement shown can be useful in improving the soundness of directionally solidified castings while maintaining the advantages associated with the use of a seed crystal contained in a seed cradle. More specifically, and under normal circumstances, the "longitudinal" axis of the part will lie substantially perpendicular to the chill plate (or other means of heat extraction) and thus be parallel to the direction of heat withdrawal. In the case of face-centered cubic metal solidification using an <001> seed, for example, the resulting <001> crystal will grow parallel to the longitudinal axis of the part.

In a situation in accordance with this invention, the longitudinal axes of the mold cavity, cradle, and seed will lie at angles other than 90° relative to the chill plate. As explained, the selected angle of inclination, for example, about 15° (from the perpendicular), can improve the soundness of cast articles, particularly in "corners" or otherwise "blind" horizontal surfaces by permitting the access of "feed metal" during solidification. Especially when using the seed and cradle arrangement shown, the orientation of the cradle need not be parallel to the longitudinal axis of the "tilted" article, and/or it may be desirable to select a seed crystal of slightly different orientation, in order to 37 compensate" for the tilting of the article cavity.

To achieve the described advantages during solidification with molds of the type shown in either FIGS. 3 or 4, angles (from the perpendicular) of between about 10° and 40° are preferred.

Also contemplated, however, is the use of angles of inclination, selected for example, from about 5° and up to about 75° (from the vertical), in order to achieve crystalline orientations in the article which are different than those of the seed. For example, a cradle containing an <001> seed (with a proper secondary orientation) could be used to produce an article exhibiting a <111> orientation (relative to its longitudinal axis) by tilting the mold cavity by about 54.7° relative to the chill plate.

For purposes of this invention, it will be understood that the various cradles described in the aforementioned copending application may all be used in conjunction with the features of this invention. In addition, various other forms may be used including vertical taps, "pigtail coils", and other known means for initiating unidirectional grain growth.

In considering the following claims, it will also be understood that variations are possible from the particular relationships of seed crystals and molds as shown in the drawings. For example, the invention contemplates a situation where a mold cavity tilted at some first angle between 5° and 75° relative to an axis normal to the chill plate, with the seed cavity (or cradle), vertical tap, or "pigtail coil" axis tilted at some second angle between 5° and 75° relative to an axis normal to the chill plate. Thus, these angles are not necessarily equal. Furthermore, the second angle may be anywhere between 0° and 5° and still within the scope of the embodiment of FIG. 3.

It will be understood that various changes and modifications may be made in the above-described system which provide the characteristics of this invention without departing from the spirit thereof particularly as defined in the following claims.

We claim:

1. In a method for the production of an article defining a central axis having a substantially unidirectional grain orientation, said method including providing a mold containing at least one mold cavity, said mold cavity having an axis coinciding with the central axis of said article and said mold cavity defining cross-sectional planar portions which are transverse to said mold cavity axis, introducing a molten charge to the mold, and providing means for maintaining a temperature gradient whereby solidification of the charge commences at the lower end of the mold cavity and progresses upwardly along a solidification front, the improvement comprising locating said mold cavity with said axis thereof tilted at an angle of from about 5 to about 75 degrees relative to the vertical, and maintaining said solidification front of the charge substantially horizontal throughout the solidification whereby said cross-sectional planar portions of said mold cavity are positioned at an angle relative to the plane of said solidification front which substantially corresponds with the angle of the mold cavity axis to the vertical, wherein said mold cavity includes at least one cavity extension in a portion of the mold cavity located above a line coinciding with said axis of the mold cavity whereby the charge fed into said extension does not solidify until after all other portions in the same transverse cross-sectional plane of the article have solidified, and including the step of removing the portion of the casting which solidified in the cavity extension after separating the casting from the mold.

2. In an apparatus for producing an article defining a central axis and having a substantially unidirectional grain orientation, said apparatus including a mold for holding a molten charge, said mold containing one or more cavities, said mold cavity having an axis coinciding with the central axis of said article, and said mold cavity defining cross-sectional planar portions which are transverse to said mold cavity axis, and means for maintaining a temperature gradient along the length of the mold whereby solidification of the charge commences at the lower end of each mold cavity and progresses upwardly along a solidification front, the improvement wherein said axis of the mold cavity is tilted at an angle from about 5 to 75 degrees relative to the vertical, the solidification front of the charge remaining substantially horizontal throughout the solidification whereby said cross-sectional planar portions of said mold cavity are positioned at an angle relative to the plane of said solidification front which substantially corresponds with the angle of the mold cavity axis to the vertical, wherein said mold cavity has at least one cavity extension in a portion of the mold located above a line coinciding with said axis of the mold cavity whereby the charge fed into said extension does not solidify until after all other portions in the same transverse cross-sectional plane of the article have solidified, the portion of the casting which solidified in the cavity extension being removed after separation of the casting from the mold.

* * * * *